United States Patent [19]

Koppang

[11] 3,938,430

[45] Feb. 17, 1976

[54] AIR VENTS

[76] Inventor: Ronald N. Koppang, 9537 Pitch Pine Drive, Shreveport, La. 71108

[22] Filed: Feb. 1, 1974

[21] Appl. No.: 438,564

Related U.S. Application Data

[63] Continuation of Ser. No. 254,380, May 18, 1972, abandoned.

[52] U.S. Cl. ..... 98/103; 49/82; 49/88; 98/107; 98/110; 98/121 A; 137/601

[51] Int. Cl.[2] ..... F24F 13/06

[58] Field of Search .... 98/40 VM, 110, 121 A, 113, 98/103, 107; 137/601; 49/82, 87, 88

[56] References Cited

UNITED STATES PATENTS

| | | | |
|---|---|---|---|
| 3,464,341 | 9/1969 | Dobrin | 98/110 |
| 3,552,295 | 1/1971 | Armstrong | 98/110 |
| 3,715,971 | 2/1973 | Moyer | 98/110 |
| 3,720,154 | 3/1973 | Biggi | 98/110 |

*Primary Examiner*—Carroll B. Dority, Jr.
*Assistant Examiner*—Ronald C. Capossela
*Attorney, Agent, or Firm*—Hubbard, Thurman, Turner & Tucker

[57] ABSTRACT

An air register of molded plastic material comprising a basic framework with slotted air openings, a pair of vanes journaled in the frame with means for opening and closing the vanes for the passage of a selected volume of air through the register; a pair of spur gears, one gear cast at an end of one vane and another integrally cast at an end of the other of said vanes, the gears being properly enmeshed for operation upon mounting the same to said framework and means for operating the gear train for movement of said vanes.

8 Claims, 7 Drawing Figures

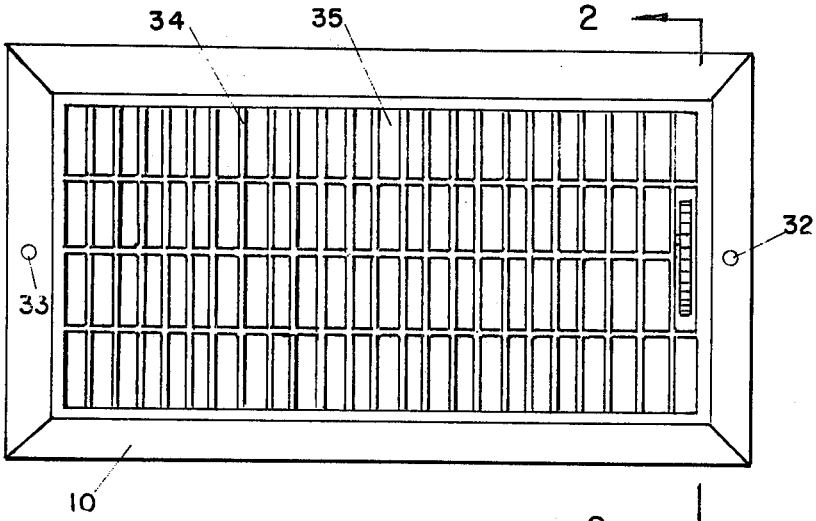
FIG. 1
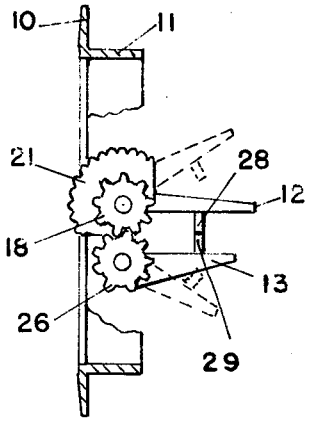
FIG. 2
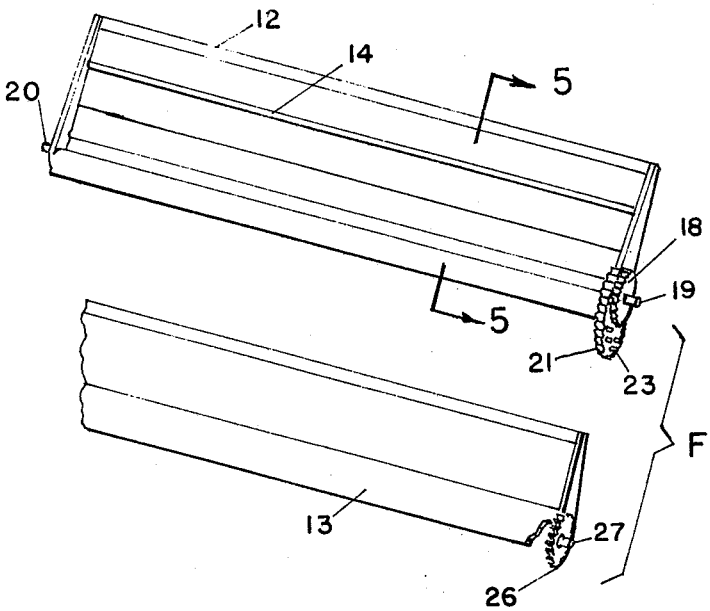
FIG. 3
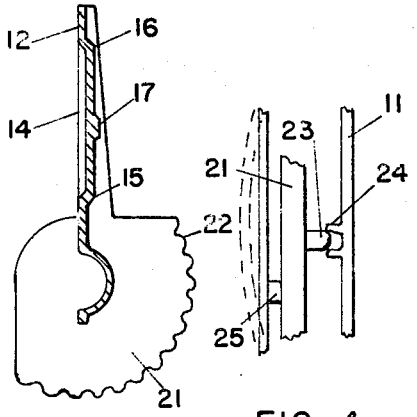
FIG. 5
FIG. 4
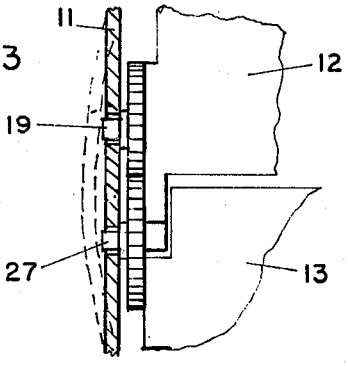
FIG. 6
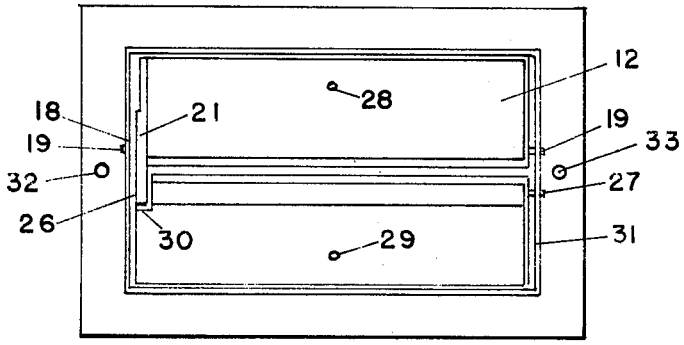
FIG. 7
INVENTOR.
Ronald N Koppang

AIR VENTS

This is a continuation of application Ser. No. 254,380, filed May 18, 1972 now abandoned.

The present invention pertains to air registers generally, but more in particular to an air register for use in heating and cooling systems such as might be found in mobile homes where lightness and compactness of component parts might be appreciated.

One of the objects of the present invention is the provision of an air register which is light in weight and inexpensive to manufacture. The present invention meets these requirements in that it is made of plastic material having very high strength and being light in weight.

A further object of the invention is to provide a register with a minimum number of parts in order to reduce the cost of manufacture and assembly.

A still further object of the invention is the provision of an air register wherein the volume of air flowing through the same may be adjusted from maximum to minimum without affecting the direction of flow.

Other objects of the invention will become apparent in the course of the following detailed description when viewed together with the accompanying drawing in which:

FIG. 1 is a front elevational view of the present invention in an air register.

FIG. 2 is a broken sectional view taken along lines 2—2 of FIG. 1.

FIG. 3 is a more-or-less exploded view of the two air vanes of the invention showing relative positions with respect to each other.

FIG. 4 is a detailed view illustrating the mechanism used to hold the vanes at various selected degrees of opening.

FIG. 5 is an enlarged cross sectional view taken along lines 5—5 of FIG. 3.

FIG. 6 is a detailed view illustrating the manner of anchoring the ends of the vanes in the framework for rotative movement.

FIG. 7 is the reverse side of the complete unit as shown in FIG. 1 but more clearly illustrating the safety openings left between the vanes and the main framework when the register is in the closed position.

In the drawing numeral 10 designates what might be called the main frame of the register and which consists in a more-or-less flat strip molded in a rectangular configuration as shown and provided with spaced ribs 34 which define air openings 35. Around the frame 10 and projecting outwardly 90° therefrom is another continuous strip 11 molded integrally with the frame and serving as a brace to add strength and rigidity to the final assembly.

In FIG. 3 which is an exploded view of the vanes of the device, the upper view shows a vane designated by the numeral 12 while the other vane is designated by the numeral 13. The upper vane consists in an elongated plate 14 lying in a flat plane but given additional strength and rigidity by providing offsets 15 and 16 plus an additional rib 17 which are more clearly seen in the sectional view of FIG. 5. The vane 13 in the lower part of the FIG. is of similar construction in cross section as that of the upper vane 12.

At one end of the upper vane 12 is a spur gear 18 molded integrally with the vane 12 and provided with an extended shaft 19. It will be noted that a similar shaft extension 20 is provided on the opposite end of the vane.

The purpose of these extended shafts is more clearly illustrated in FIG. 6 which shows them serving as journals in the brace 11 of the device to provide proper support to the vanes when in an operative position. To mount either of the vanes in the frame, it is only necessary to force the brace 11 outwardly at either end as illustrated by the dotted lines, then insert the shaft into a prepared hole. The resiliency which is inherent in the molded plastic will allow such yielding and yet will return the bent portion back to its original shape when such pressure is released.

Also molded integrally with the vane proper and positioned in axial alignment with the spur gear 18 and its shaft 19 is an operating segment 21 consisting of an arcuate segment as illustrated in FIG. 5 with serrations 22 around the periphery thereof. On the outer face of the segment 21 are small projections 23 spaced both radially and circumferencially with respect to the axis of the shaft 19. The purpose of these projections may be seen by reference to FIG. 4 which shows one of them being held in a given rotative position around the shaft axis by a pair of stops 24 molded on the inner side wall of the brace 11 of the main framework. As can be seen here, when the segment 21 is rotated, one of the projections will abutt the outer edge of a stop 24 in interference. However, with an additional force applied to the rotative movement of the segment, the projection 23 will force one of the grid members inwardly as shown by the dotted line and permit the projection 23 to snap in between the two stops as shown on the drawing. Still an added force will remove the projection 23 from the stop and permit a further degree of rotation of the vane. Numeral 25 designates an additional stop molded on one of the grid members. This stop simply serves as a spacer and wear strip when being engaged by the segment 21 during the above described vane adjustment.

As before mentioned, the vane 13, illustrated in FIG. 3, is of similar construction to that of the vane 12 with a spur gear 26 being integrally cast at one end thereof and having a pair of stub shafts 27.

The operation of the register will be clearly understood while observing the detailed sectional view of FIG. 2. Here, the two vanes 12 and 13 are shown mounted in operative positions in the brace 11, with the sub-shafts of each being spaced so as to properly enmesh the two spur gears 18 and 26. Note that when in such position the actuating segment 21 projects slightly above the face of the frame 10 so that when rotated as formerly described, the vanes will move in arcuate fashion as illustrated by the dotted lines, hence opening and closing the air passageway through the register frame 10. Since the angular positions of the vanes herein described are the factors in governing the amount of airflow, it is now understandable that air flowing simultaneously by both vanes from the back to the front side of the register will not substantially change its direction of flow. While such a feature may seem unimportant it will be remembered that when an air register is installed and the airflow regulated by volume, there is usually an air stream in a directional flow from the register outwardly into the room. The furniture or working area is then arranged to suit so that the air flow may or may not be felt. In constructions of the former art, when the adjustable vanes are regulated for a volume of flow, the direction is also changed, directing the air either toward or away from the area as originally planned.

Also shown in FIG. 2 is a pair of stop buttons 28 and 29 one affixed to the back side of each vane 12 and 13. These stops limit the rotation of the vanes to a position allowing maximum air flow through the register.

FIG. 7 is a rear view of the assembled register and shows how the two air controlling vanes are mounted in the frame with the two spur gears 18 and 26 being enmeshed and the vane actuating segment 21 meeting in a slot 30 provided in the lower vane 13. It can also be seen here that a space 31 is deliberately left around the perimeter of the vanes for a slight flow of air when the vanes are turned to a closed position, thus preventing an undue back pressure on the heating or air cooling system.

It cannot be overemphasized that each vane of the invention includes an integrally molded working gear as part of the casting which, when enmeshed with the other gear as described above, forms a complete working gear train. Also as noted, one of the vanes includes the adjusting segment 21 as part of the vane as cast. Such construction goes far beyond the former art wherein similar devices include separate configurations for each separate part all of which must be finally joined by some means to other parts to make a workable assembly.

As aforementioned, the device is of molded plastic and is suitably braced to withstand the normal pressures that might occur by a person walking across the same or some item of furniture accidently contacting the same. It can be molded in any color to match any decor and is, of course, rustproof, since there are no metal parts. The device may be mounted in an opening by a pair of screws or nails using the cast holes 32 and 33 in the framework.

It is to be remembered that the illustration given has been by way of example only and that changes in actual construction could be made without departing from the scope of the following claims.

I claim:

1. A molded plastic air register adapted to be mounted in a wall or floor opening, comprising:

a frame member provided with an open gridwork for the passage of air therethrough and a continuous integrally molded strip about said gridwork extending from one side of said frame member, and a pair of vane members pivotally mounted on said frame member between opposing sides of said strip member by extensions integrally molded to said vane members to permit said vane members to move between positions providing a different restriction to the flow of air through said gridwork, said vane members including actuating means integrally molded therewith for moving said vane members between said positions, said actuating means including a gear integrally molded to the same end of each of said vane members, and an actuator integrally molded with one of said gears and extending into said gridwork to be actuated from the side of said frame opposite to that on which the vane members are mounted.

2. The air register of claim 1 wherein said actuator is formed on the side of said one of said spur gears facing the vane member that is integrally formed therewith, and the other vane member includes a slot adjacent the spur gear formed integrally therewith for receipt of said actuator as it is operated to move said vane members.

3. The air register of claim 1 wherein said vane members are mounted to move in an arcuate path in opposite directions.

4. The air register of claim 1 wherein said actuator extends to where it is substantially flush with the surface of said gridwork.

5. The air register of claim 1 further including stop means associated with said actuating means for providing interference to movement of said vane members between said positions whereby the vane members may be selectively positioned to provide a desired restriction to flow of air through said register.

6. The air register of claim 5 wherein said stop means includes spaced projections integrally molded with one of said actuating means and said frame, and an interference member integrally molded with the other of said actuating means and frame, said projections and interference member adapted to be in substantial interference during actuation of said actuating means.

7. The air register of claim 6 wherein said spaced projections are integrally molded with said actuating means.

8. An air register adapted to be mounted in a wall or floor opening, comprising:

a frame member provided with an open gridwork for the passage of air therethrough and a continuous strip about said gridwork extending from one side of said frame member, and a pair of molded plastic vane members pivotally mounted on said frame member between opposing sides of said strip member by extensions integrally molded to said vane members to permit said vane members to move between positions providing a different restriction to the flow of air through said gridwork, said vane members including actuating means integrally molded therewith for moving said vane members between said positions, said actuating means including a gear integrally molded to the same end of each of said vane members, and an actuator integrally molded to one of said gears and extending into said gridwork to be actuated from the side of said frame opposite to that on which the vane members are mounted.

* * * * *